US009894725B2

(12) United States Patent
Aydin

(10) Patent No.: US 9,894,725 B2
(45) Date of Patent: Feb. 13, 2018

(54) CURRENT FEEDBACK FOR IMPROVING PERFORMANCE AND CONSISTENCY OF LED FIXTURES

(71) Applicant: PHILIPS LIGHTING HOLDING B.V., Eindhoven (NL)

(72) Inventor: Tarek Aydin, Salem, NH (US)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 14/775,737

(22) PCT Filed: Mar. 5, 2014

(86) PCT No.: PCT/IB2014/059450
§ 371 (c)(1),
(2) Date: Sep. 14, 2015

(87) PCT Pub. No.: WO2014/141002
PCT Pub. Date: Sep. 18, 2014

(65) Prior Publication Data

US 2016/0029455 A1 Jan. 28, 2016

Related U.S. Application Data

(60) Provisional application No. 61/783,714, filed on Mar. 14, 2013.

(51) Int. Cl.
*H05B 33/08* (2006.01)

(52) U.S. Cl.
CPC ..... *H05B 33/0851* (2013.01); *H05B 33/083* (2013.01); *H05B 33/0815* (2013.01); *H05B 33/0827* (2013.01); *H05B 33/0854* (2013.01)

(58) Field of Classification Search
CPC ..... H05B 33/0815; H05B 33/0827; H05B 33/083; H05B 33/0851; H05B 33/0854
(Continued)

(56) References Cited

U.S. PATENT DOCUMENTS 6,091,614 A 7/2000 Malenfant
6,441,558 B1 * 8/2002 Muthu ..... H05B 33/0863 315/118
(Continued)

FOREIGN PATENT DOCUMENTS

CN 101010649 A 8/2007
CN 101960922 A 1/2011
(Continued)

*Primary Examiner* — Alexander H Taningco
*Assistant Examiner* — Kurtis R Bahr
(74) *Attorney, Agent, or Firm* — Akarsh P. Belagodu

(57) ABSTRACT

A lighting system includes a power converter connected to mains voltage and configured to provide a driving current responsive to a control signal. A voltage measurement circuit is configured to provide a voltage sense signal indicative of an amplitude of the mains voltage. A light-emitting diode (LED) module includes at least one string of LEDs that emit light responsive to the driving current, and is configured to detect an LED current through the at least one string and output a current feedback signal indicative of the detected LED current. A driver controller is configured to output the control signal responsive to the voltage sense signal and the current feedback signal.

17 Claims, 6 Drawing Sheets

(58) Field of Classification Search
USPC ..... 315/291–294, 297, 307–308
See application file for complete search history.

(56) References Cited

U.S. PATENT DOCUMENTS

| | | | | |
|---|---|---|---|---|
| 7,233,115 | B2 * | 6/2007 | Lys | F21S 48/325 315/224 |
| 7,605,550 | B2 * | 10/2009 | Ferentz | H05B 33/0815 315/312 |
| 7,609,008 | B1 | 10/2009 | Kohler | |
| 7,928,670 | B2 * | 4/2011 | Chen | H05B 33/0815 315/159 |
| 8,644,998 | B2 * | 2/2014 | Nerone | H05B 37/0281 315/291 |
| 8,896,235 | B1 * | 11/2014 | Shum | H05B 33/0824 315/193 |
| 9,078,315 | B2 * | 7/2015 | Pantano | H05B 33/0827 |
| 2005/0218838 | A1 * | 10/2005 | Lys | F21S 48/325 315/291 |
| 2007/0195025 | A1 * | 8/2007 | Korcharz | G09G 3/3413 345/82 |
| 2008/0018261 | A1 | 1/2008 | Kastner | |
| 2008/0116818 | A1 * | 5/2008 | Shteynberg | H05B 33/0815 315/192 |
| 2008/0180040 | A1 | 7/2008 | Prendergast et al. | |
| 2009/0315484 | A1 | 12/2009 | Cegnar et al. | |
| 2010/0007644 | A1 | 1/2010 | Kim et al. | |
| 2010/0060204 | A1 | 3/2010 | Ohtake et al. | |
| 2010/0308749 | A1 * | 12/2010 | Liu | H05B 33/0815 315/307 |
| 2011/0234115 | A1 | 9/2011 | Shimizu et al. | |
| 2011/0309759 | A1 * | 12/2011 | Shteynberg | H05B 33/0815 315/201 |
| 2012/0032605 | A1 | 2/2012 | Peng | |
| 2012/0062136 | A1 * | 3/2012 | Tsai | H05B 33/0827 315/224 |
| 2012/0133293 | A1 | 5/2012 | Shin | |
| 2013/0154495 | A1 * | 6/2013 | He | H02M 1/44 315/210 |

FOREIGN PATENT DOCUMENTS

| | | | |
|---|---|---|---|
| CN | 102427633 | A | 4/2012 |
| TW | 201304597 | A | 1/2013 |
| WO | 2008138097 | A1 | 11/2008 |
| WO | 2010035155 | A1 | 4/2010 |
| WO | 2011033415 | A1 | 3/2011 |
| WO | 2011128798 | A1 | 10/2011 |
| WO | 2012110973 | A1 | 8/2012 |
| WO | 2013014607 | A1 | 1/2013 |

* cited by examiner

CURRENT FEEDBACK FOR IMPROVING PERFORMANCE AND CONSISTENCY OF LED FIXTURES

CROSS-REFERENCE TO PRIOR APPLICATIONS

This application is the U.S. National Phase application under 35 U.S.C. §371 of International Application No. PCT/IB14/059450, filed on Mar.05, 2014, which claims the benefit of U.S. Provisional Patent Application Ser. No. 61/783,714, filed on Mar. 14, 2013. These applications are hereby incorporated by reference herein.

TECHNICAL FIELD

The present invention is directed generally to control of solid state lighting devices. More particularly, various inventive apparatuses and methods disclosed herein relate to implementing feedback control to improve performance and consistency of solid state lighting devices.

BACKGROUND

Existing solid state fixtures including light emitting diodes ("LEDs") commonly include power supplies that utilize offline power converter topologies and operate in an open loop manner. The power supply may include a microcontroller (μC) that stores a power curve and outputs a pulse-width modulated (PWM) signal as a control signal to a power factor control (PFC) chip, which adjusts wattage of the buck power converter over a universal input voltage range from 90 volts AC to 480 volts AC. PFC chips may typically have tolerances of up to about 12% with respect to gain. Moreover, the forward voltage drops of LEDs also vary by bin and drive current. As a result, it is usually necessary to rework and/or change resistors within the power supplies of existing solid state fixtures during manufacture to adjust the power rating of the supply/fixture to meet desired specifications prior to finalizing the product for shipment or consumer use so that the supply/fixtures are calibrated to emit light having brightness that meets desired specifications. Such rework may be a time consuming and inefficient process, and may result in problems when the AC input voltage is above or below its nominal value or on the low end of an electronic low voltage (ELV) dimmer, where inconsistencies in drive current may visibly appear from fixture to fixture. Typically solutions to these problems include limiting low end dimming to obscure low end inconsistencies in driving current. This would however result in dead travel near the low end of the dimmer.

Thus, it would be desirable to provide a solid state lighting system that maintains consistent lighting current and brightness over time, reduces or eliminates the need to rework supply/fixtures during manufacture, enables consistent low end dimming of cascaded fixtures, improves dimmer compatibility and/or and sets a hard upper limit for lighting current.

SUMMARY

Generally, in one aspect, a lighting system includes a power converter connected to mains voltage and configured to provide a driving current responsive to a control signal; a voltage measurement circuit configured to provide a voltage sense signal indicative of an amplitude of the mains voltage; a light emitting diode (LED) module including at least one string of LEDs that emit light responsive to the driving current, and configured to detect an LED current through the at least one string and output a current feedback signal indicative of the detected LED current; and a driver controller configured to output the control signal responsive to the voltage sense signal and the current feedback signal.

In another aspect, a lighting driver includes a power converter connected to mains voltage and configured to provide a driving current to a solid state lighting load responsive to a control signal; a voltage measurement circuit configured to provide a voltage sense signal indicative of an amplitude of the mains voltage; and a driver controller configured to output the control signal responsive to the voltage sense signal and a current feedback signal indicative of a lighting current through the solid state lighting load, wherein the power converter provides the driving current to maintain the lighting current at a selected constant level regardless of the amplitude of the mains voltage.

In another aspect, a method of controlling a solid state lighting load includes converting mains voltage to provide a driving current to the solid state lighting load; generating a current feedback signal indicative of a lighting current through the solid state lighting load; and detecting an amplitude of the mains voltage, wherein said converting comprises providing the driving current to maintain light emitted from the solid state lighting load at a selected constant brightness responsive to the detected amplitude of the mains voltage and the current feedback signal.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, and others.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources such as one or more strings of LEDs as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers.

The term "addressable" is used herein to refer to a device (e.g., a light source in general, a lighting unit or fixture, a controller or processor associated with one or more light sources or lighting units, other non-lighting related devices, etc.) that is configured to receive information (e.g., data) intended for multiple devices, including itself, and to selectively respond to particular information intended for it. The term "addressable" often is used in connection with a networked environment (or a "network," discussed further below), in which multiple devices are coupled together via some communications medium or media.

In one network implementation, one or more devices coupled to a network may serve as a controller for one or more other devices coupled to the network (e.g., in a master/slave relationship). In another implementation, a networked environment may include one or more dedicated controllers that are configured to control one or more of the devices coupled to the network. Generally, multiple devices may be coupled to some network and each may have access to data that is present on the communications medium or media; however, a given device may be "addressable" in that it is configured to selectively exchange data with (i.e., receive data from and/or transmit data to) the network, based, for example, on one or more particular identifiers (e.g., "addresses") assigned to it.

The term "network" as used herein refers to any interconnection of two or more devices (including controllers or processors) that facilitates the transport of information (e.g. for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present disclosure, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as discussed herein may employ one or more wireless, wire/cable, and/or fiber optic links to facilitate information transport throughout the network.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

In the following detailed description, for purposes of explanation and not limitation, representative embodiments disclosing specific details are set forth in order to provide a thorough understanding of the present teachings. However, it will be apparent to one having ordinary skill in the art having had the benefit of the present disclosure that other embodiments according to the present teachings that depart from the specific details disclosed herein remain within the scope of the appended claims. Moreover, descriptions of well-known apparatuses and methods may be omitted so as to not obscure the description of the representative embodiments. Such methods and apparatuses are clearly within the scope of the present teachings.

Generally, it is desirable that light from a solid state lighting load, such as a light emitting diode (LED) module for example, may be emitted at a selected constant brightness or lumens. It is desirable that the LED current through the LED module is maintained at a selected constant level over the lifetime of the LED module so that light of the selected brightness may be emitted by the LED module, regardless of the amplitude of the mains voltage powering the lighting system, and despite aging and/or temperature variations of the LED module and tolerances of the power supply and/or lighting drivers. It is also generally desirable that when LED modules each designed to emit light of a selected brightness are disposed near each other, they consistently emit light of relatively the same brightness. It is still further desirable that such respective LED modules of similar design and disposed near each other may be controllable by a same dimming device to emit light of relatively the same brightness. In the various embodiments, these objectives and others may be achieved by controlling the driving current provided to an LED module responsive to an amplitude of the mains voltage and a current feedback signal indicative of the detected LED current through the LED module.

Figure 1:
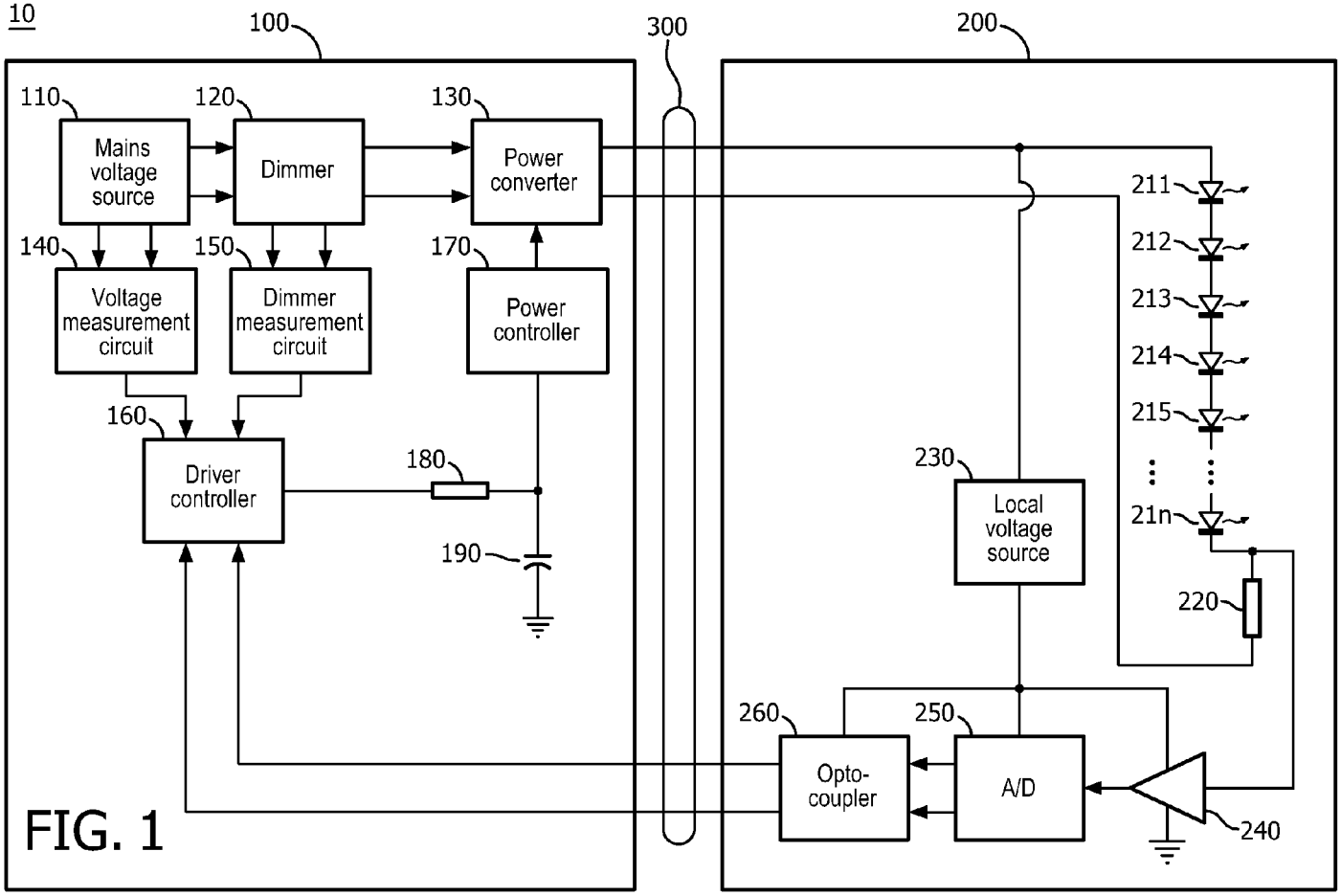
FIG. 1 illustrates a lighting system including a lighting driver and a light emitting diode (LED) module, according to a representative embodiment.

FIG. 1 illustrates a lighting system 10 including a lighting driver 100 and a light emitting diode (LED) module 200, according to a representative embodiment. Lighting driver 100 may include mains voltage source 110, dimmer 120, power converter 130, voltage measurement circuit 140, dimmer measurement circuit 150, driver controller 160 and power controller 170.

In some embodiments, mains voltage source 110 may provide AC mains voltage of 120 volts AC, 220 volts AC, 277 volts AC, 480 volts AC, or any other AC voltage, depending on the power supply connected to lighting system 10. Mains voltage source 110 may be characterized as a universal AC mains voltage source providing any mains voltage within a range of about 90 volts AC to 480 volts AC, for example. Lighting system 10 is thus designed as operable responsive to various different AC main voltages. In some embodiments, dimmer 120 may be an electronic low voltage (ELV) dimmer, a triac dimmer, or other type dimmers that cut or modify a phase of the mains voltage provided to power converter 130 to adjustably dim the light emitted by LED module 200 to a desired dimming level. Dimmer 120 may be responsive to a wall mounted switch or potentiometer manipulated by a system user, Voltage measurement circuit 140 as shown in FIG. 1 is connected to mains voltage source 110, and is configured to measure the amplitude of the mains voltage, and output a voltage sense signal indicative of the amplitude of the mains voltage to driver controller 160. Since rectification of the mains voltage may typically be a function of power converter 130, the mains voltage provided to voltage measurement circuit 140 may or may not be rectified. Voltage measurement circuit 140 thus may or may not rectify the mains voltage prior to measurement. The voltage sense signal indicates whether the AC mains voltage provided by mains voltage source 110 is 120 volts AC, 277 volts AC, or 480 volts AC for example. In some embodiments, voltage measurement circuit 140 may include diodes for rectifying the AC mains voltage. The voltage sense signal may be an analog signal.

Dimmer measurement circuit 150 as shown in FIG. 1 is connected to the mains voltage output from dimmer 120, and is configured to detect if the phase of the mains voltage output from dimmer 120 is cut or modified and output a dimmer sense signal to driver controller 160 responsive to the detected cut or modified phase of the mains voltage. In some embodiments, dimmer measurement circuit 150 may include filters and analog to digital converters for example, and may convert the mains voltage output from the dimmer 120 into a square wave and output the square wave as the dimmer sense signal. The square wave may have a duty cycle corresponding to the amount of phase cut from the mains voltage by dimmer 120. For example, in some embodiments dimmer measurement circuit 150 may convert mains voltage that does not have any phase cut into a square wave having 50% duty cycle indicative of a maximum desired lighting level (no dimming), and may convert mains voltage having a maximum amount of phase cut into a square wave having a minimal duty cycle indicative of a minimal desired lighting level (maximum dimming).

Power converter 130 is connected to the mains voltage provided from dimmer 120, and is controlled by power controller 170 responsive to a control signal provided from driver controller 160 to provide a driving current to LED module 200. As will be subsequently described in further detail, power converter 130 may be characterized as a constant power source configured to provide a driving current to LED module 200, to maintain the LED current through LEDs 211, 212, 213, 214, 215, . . . , 21*n* at a selected constant level, to consequently maintain light emitted from LED module 200 at a selected constant brightness. In the representative embodiment shown in FIG. 1, power converter 130 includes a buck power converter. In some representative embodiments, power converter 130 may instead include a flyback power converter. Power controller 170 may include a power factor correction (PFC) chip configured to control power converter 130 responsive to a control signal output from driver controller 160 through resistor 180. In some representative embodiments, the control signal may be a pulse-width modulation (PWM) signal, and/or power controller 170 may be integrated within power converter 130. Resistor 180 as shown includes a first terminal end connected to driver controller 160, and a second terminal end connected to power controller 170. As further shown, capacitor 190 includes a first terminal end connected to the second terminal end of resistor 180, and a second terminal end connected to ground. The operation and structure of power converter 130, which as noted above may be a buck power converter, a flyback power converter, or other types of power converters in certain representative embodiments, are well known and further description thereof is omitted so as to not obscure the description. Likewise, the operation and structure of power controller 170, which as noted above may be a PFC chip or the like in certain representative embodiments, are well known and further description thereof is also omitted.

LED module 200 as shown in FIG. 1 includes a string of LEDs 211, 212, 213, 214, 215, . . . , 21*n* connected in series. Although the string is shown as including a plurality of LEDs, in some representative embodiments the string may include a single LED. Cable 300 interconnects lighting driver 100 and LED module 200. Cable 300 includes a first wire connected between power converter 130 and a first end of the string at an anode of LED 211, and a second wire connected between power converter 130 and a second end of the string at a cathode of LED 21*n* via resistor 270. LEDs 211, 212, 213, 214, 215, . . . , 21*n* are driven to emit light responsive to the driving current provided from power converter 130 to the string via the first wire of cable 300.

LED module 200 as shown in FIG. 1 further includes amplifier 240 having an input connected to a node between LED 21*n* of the string and resistor 270. Amplifier 240 may be an operational amplifier (op-amp), and is configured to amplify the LED current (lighting current) that has passed or flowed through the string at the node between LED 21*n* and resistor 270, and provide the amplified LED current as a detected LED current to analog to digital (A/D) converter 250. A/D converter 250 is configured to convert the detected LED current into a digital signal. The digital signal output from A/D converter 250 may be characterized as a current feedback signal indicative of the detected LED current through the string. An optical isolator (opto-coupler) 260 is connected to the output of A/D converter 250, and is configured to transmit the current feedback signal from LED module 200 via cable 300 to driver controller 160 within lighting driver 100. In a representative embodiment, A/D converter 250 may include an N-bit analog to digital converter where N is a real number greater than or equal to 2. For example, A/D converter 250 may include a 12 bit analog to digital converter. Optical isolator 260 may include a digital I2C opto-coupler, or any other sufficiently fast digital opto-coupler, and is configured to provide the current feedback signal to lighting driver 100 via two additional wires of cable 300. Optical isolator 260 may be disposed exteriorly of LED module 200.

As noted above, power converter 130 in the representative embodiment of FIG. 1 includes a buck power converter, and is thus connected to a different ground than driver controller 160. That is, power converter 130 and driver controller 160 have isolated ground references. Since the ground of LED module 200 is floating with respect to the ground of driver controller 160, LED module 200 further includes local voltage source 230 connected to power converter 130. Local voltage source 230 is configured to provide a local voltage to power amplifier 240, A/D converter 250 and optical isolator 260. In a representative embodiment, local voltage source 230 may include one or more zener diodes or DC-DC switches, and may provide a local voltage of 5 volts DC for example. In representative embodiments where power converter 130 includes a flyback power converter instead of a buck power converter, if the ground connected to the flyback power converter may be the same as the ground connected to driver controller 160, local voltage source 230 and optical isolator 260 may be excluded from LED module 200, A/D converter 250 and amplifier 240 may be powered off the same source as driver controller 160, i.e., via an auxiliary rail (not shown) from power converter 130, and the current feedback signal may be provided directly to driver controller 160 as a digital signal from A/D converter 250 or as an analog signal in the case that A/D converter 250 is further excluded from LED module 200. In general, in the case that power converter 130 and driver controller 160 share a common ground reference and thus have non-isolated ground references, local voltage source 230 and optical isolator 260 may be excluded from LED module 200. In the case that A/D converter 250 is further excluded, driver controller 160 may be configured as an including an A/D converter for converting the current feedback signal received in analog form.

In a representative embodiment, driver controller 160 within lighting driver 100 is connected to voltage measurement circuit 140, dimmer measurement circuit 150 and cable 300, and is configured to output the control signal responsive to the voltage sense signal, the dimmer sense signal and the current feedback signal. In some representative embodiments, lighting driver 100 may be implemented without a dimming feature, and thus dimmer 120 and dimmer measurement circuit 150 may be excluded and the mains voltage from mains voltage source may be provided directly to power converter 130. In such a case, driver controller 160 may be configured to output the control signal responsive to the voltage sense signal the current feedback signal.

As described previously, in a representative embodiment the control signal may be a PWM signal, or an analog signal in the case that driver controller is configured to include a digital to analog converter, and power controller 170 may be configured as responsive to the PWM signal to control power converter 130 to adjust the driving current so that the LED current (lighting current) passed through the string is maintained at a selected constant level. In a representative embodiment, driver controller 160 may be a microprocessor or microcontroller, and may include memory and/or be connected to memory. The functionality of driver controller 160 may be implemented by one or more processors or controllers. In either case, driver controller 160 may be programmed using software or firmware (e.g., stored in memory) to perform the corresponding functions described, or may be implemented as a combination of dedicated hardware to perform some functions and a processor (e.g., one or more programmed microprocessors and associated circuitry) to perform other functions. Examples of controller components that may be employed in various representative embodiments include, but are not limited to, conventional microprocessors, microcontrollers, application specific integrated circuits (ASICs) and field programmable gate arrays (FPGAs).

Figure 2:
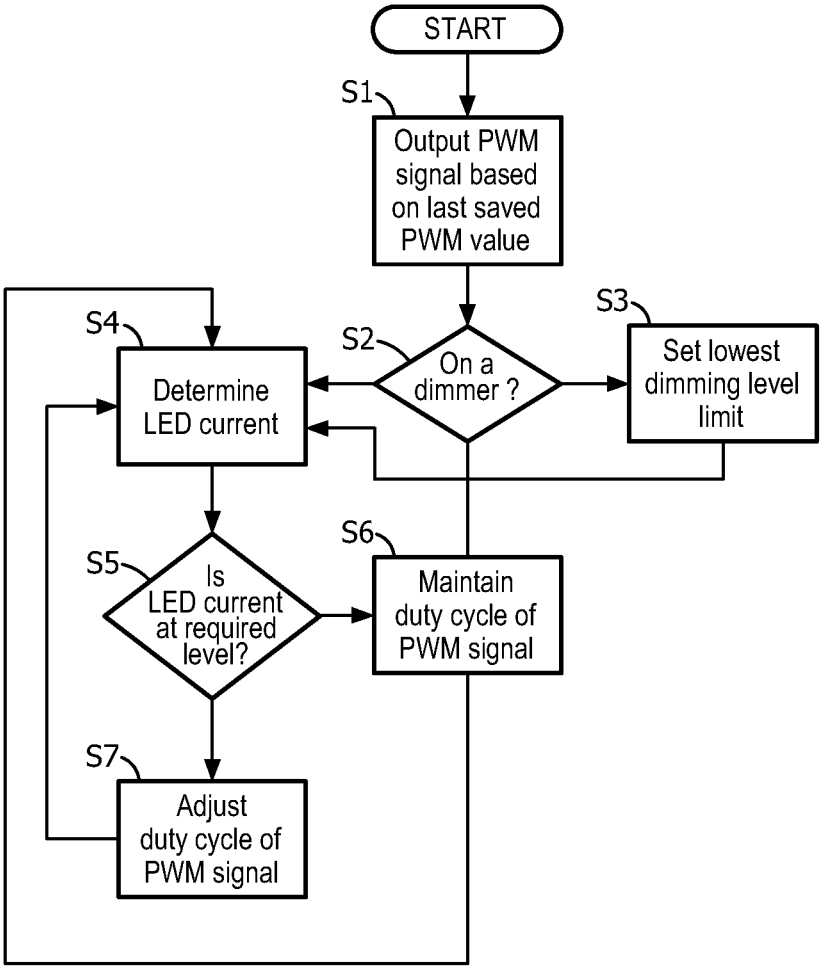
FIG. 2 illustrates a flow diagram showing a process of generating the control signal, according to a representative embodiment.

FIG. 2 illustrates a flow diagram showing a process of generating the control signal described with respect to FIG. 1, according to a representative embodiment. In this representative embodiment, the control signal is understood to be a PWM signal, although in other representative embodiments control signal may have a different format. Upon starting the process responsive to turning on mains voltage source 110 of lighting driver 100 to provide mains voltage for powering LED module 200 of lighting system 10, driver controller 160 outputs a PWM signal in step S1 that has a duty cycle based on a last saved PWM value to power controller 170. Thereafter driver controller 160 determines in step S2 whether or not lighting system 10 is configured as including a dimmer such as dimmer 120, according to configuration information that may be stored in memory for example or responsive to a change in the phase of the mains voltage indicative that a dimmer such as dimmer 120 has been enabled or placed in the circuitry of lighting driver 100. In the event that driver controller 160 determines in step S2 that lighting system 10 is configured as including a dimmer, driver controller 160 subsequently sets a lowest dimming level limit in step S3. The purpose of setting the lowest dimming level in step S3 is so that driver controller 160 does not brown out or lose control of lighting system 10 in the event that dimmer 120 is able to go to levels close to zero. Hence, the minimum dimming level is used to always keep power converter 130 on to the extent that an auxiliary rail (not shown) of power converter 130 can provide enough power to driver controller 160. In the event that driver controller 160 determines in step S2 that lighting system 10 is not configured as including a dimmer, the process proceeds to step S4 where driver controller 160 determines the LED current according to the current feedback signal. Thereafter driver controller 160 determines in step S5 if the LED current is at a required level according to either the voltage sense signal and the dimmer sense signal in the case that lighting system 10 includes a dimmer, or according to the voltage sense signal in the case that lighting system 10 does not include a dimmer. In the event that it is determined in step S5 that the LED current is at the required level, driver controller 160 maintains the duty cycle of the PWM signal in step s6. In the event that it is determined in step S5 that the detected LED current is not at the required level, driver controller 160 adjusts the duty cycle of the PWM signal in step s7 so that the driving current provided by power converter 130 may consequently adjust the driving current so that the LED current through the string in LED module 200 may be returned to the selected constant level. The process subsequently loops through steps S4-S7 to maintain the LED current through the string in LED module 200 at the selected constant level.

In accordance with the representative embodiment described with respect to FIGS. 1 and 2, the current feedback signal indicative of the LED current through the string is used to adjust the control signal (PWM signal) output from driver controller 160, to compensate for any inherent design/manufacturing tolerances in power controller 170 and/or power converter 130, and to consequently ensure that the appropriate driving current is provided to LED module 200. Accordingly, the LED current (lighting current) passed through the string may be maintained at a selected constant level, and consequently the light emitted by LED module may be maintained at a selected constant brightness, despite such tolerances. Also, the LED current through LED module 200 may be maintained at a selected constant level over the lifetime of LED module 200, regardless of the amplitude and/or variations of the mains voltage powering lighting system 10, and despite aging and/or temperature variations of LEDs 211, 212, 213, 214, 215, . . . , 21*n* within LED module 200. Moreover, power converter 130 may be controlled responsive to the current feedback signal to reduce and/or eliminate flicker at lower dimming levels, so that lighting system 10 may be compatible with a wide range of different dimmers. Also, in the event of a shorted LED within the string, the current could be maintained constant responsive to the current feedback signal. Additionally, a maximum string current may be set in the case of a failure in the system.

Figure 3A:
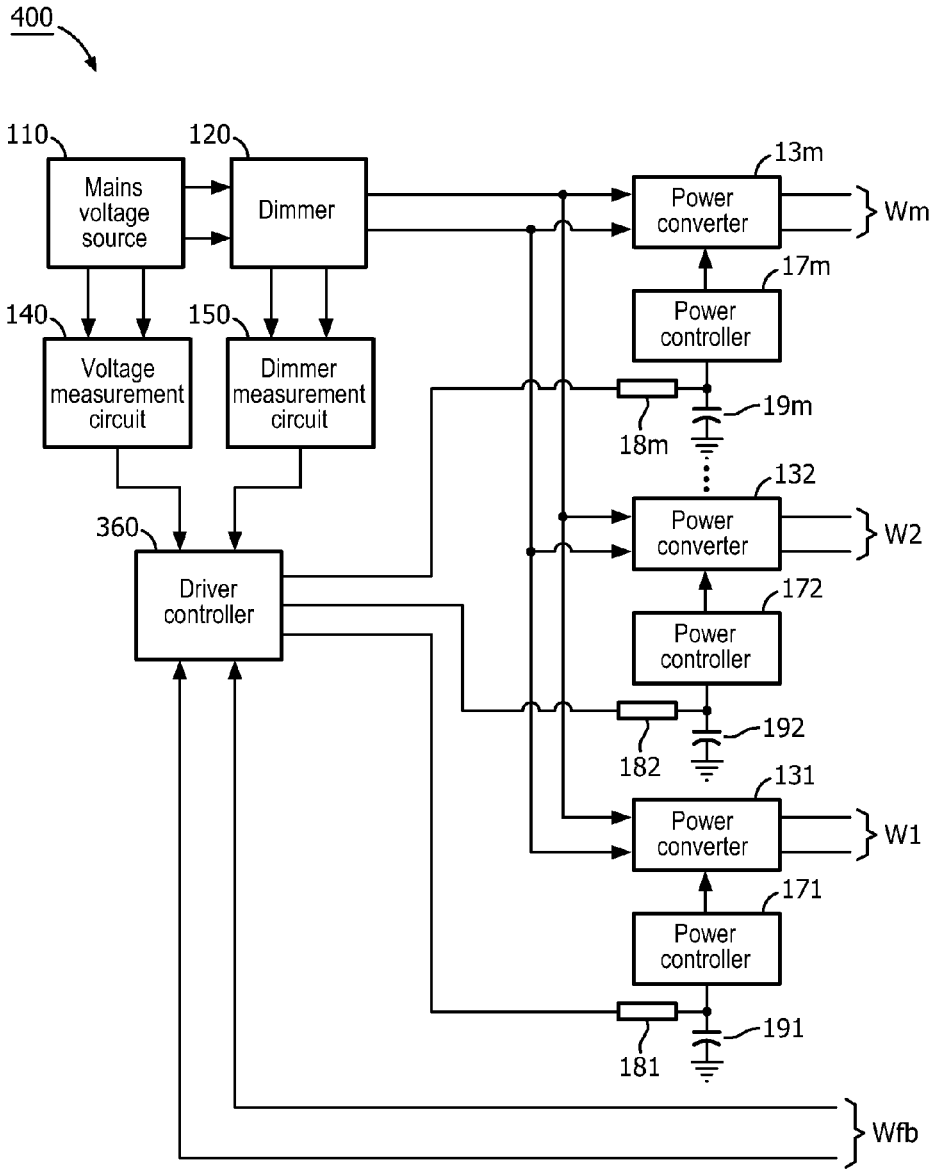
FIG. 3A illustrates a lighting driver, according to a representative embodiment.
Figure 3B:
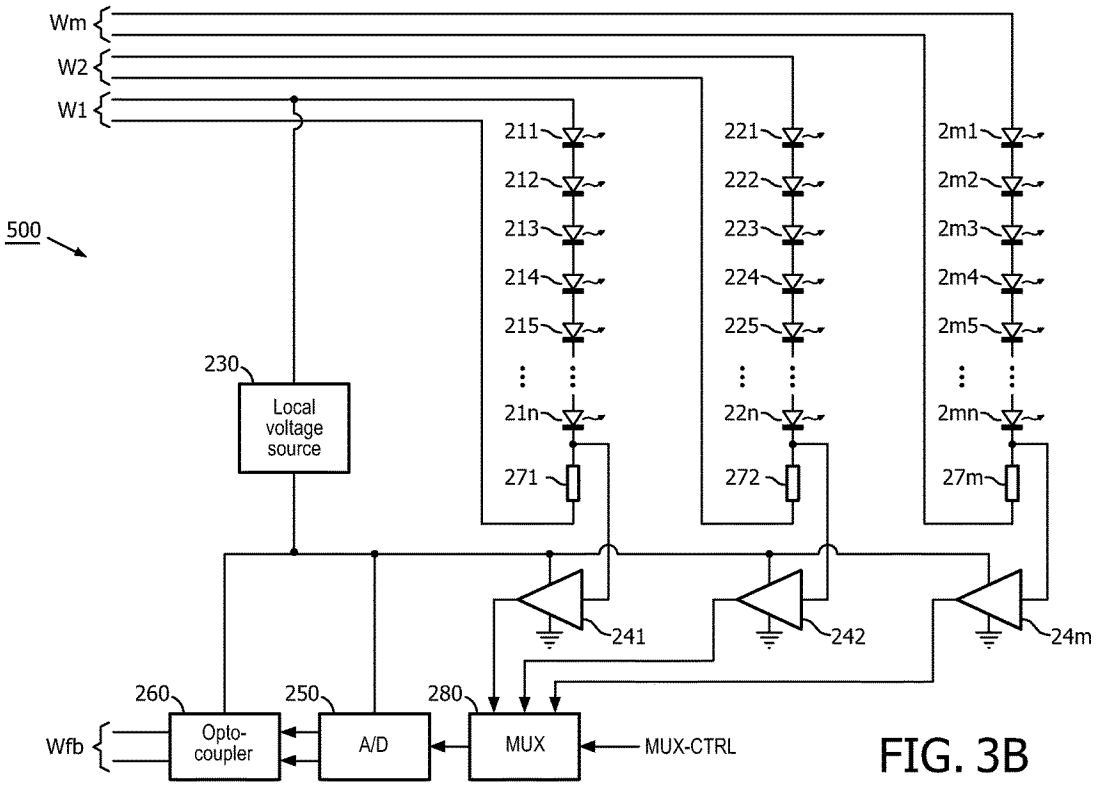
FIG. 3B illustrates an LED module usable with the lighting driver of FIG. 3A, according to a representative embodiment.

FIG. 3A illustrates a lighting driver 400 and FIG. 3B illustrates an LED module 500 usable with the lighting driver 400 of FIG. 3A, according to a representative embodiment. Lighting driver 400 and lighting module 500 include similar components as lighting driver 100 and LED module 200 shown in FIG. 1 which may be denoted with similar reference numerals. Detailed description of the similar components may hereinafter be omitted so as to not obscure the description of this representative embodiment.

As shown in FIG. 3B, LED module 500 is configured as including a plurality of strings connected to different driving currents respectively provided by power converters 131, 132, . . . , 13*m* within lighting driver 400. The LED currents (lighting currents) through each of the strings within lighting module 500 may thus be independently controlled so as to be maintained at a same selected constant level, so that the light emitted from the strings may consequently be maintained at selected constant brightness.

Lighting driver 400 as shown in FIG. 3A includes mains voltage source 110, dimmer 120, voltage measurement circuit 140 and dimmer measurement circuit 150 of similar function and interconnection as described with respect to FIG. 1. Dimmer 120 is configured as previously described to output mains voltage which may or may not have cut or modified phase to each of power converters 131, 132, . . . , 13*m*.

Driver controller 360 shown in FIG. 3A is configured to provide a first control signal to power controller 171 through resistor 181. Resistor 181 includes a first end terminal connected to driver controller 360, and a second end terminal connected to power controller 171. Capacitor 191 includes a first end terminal connected to the second end terminal of resistor 181, and a second end terminal connected to ground. Power controller 171 controls power converter 131 to provide a first driving current to lighting module 500 via wiring pair w1. Driver controller 360 is further configured to provide a second control signal to power controller 172 through resistor 182. Resistor 182 includes a first end terminal connected to driver controller 360, and a second end terminal connected to power controller 172. Capacitor 192 includes a first end terminal connected to the second end terminal of resistor 182, and a second end terminal connected to ground. Power controller 172 controls power converter 132 to provide a second driving current to lighting module 500 via wiring pair w2. Driver controller 360 is still further configured to provide an mth control signal to power controller 17*m* through resistor 18*m*. Resistor 18*m* includes a first end terminal connected to driver controller 360, and a second end terminal connected to power controller 17*m*. Capacitor 19*m* includes a first end terminal connected to the second end terminal of resistor 18*m*, and a second end terminal connected to ground. Power controller 17*m* controls power converter 13*m* to provide an mth driving current to lighting module 500 via wiring pair wm.

Lighting module 500 as shown in FIG. 3B includes local voltage source 230, A/D converter 250 and optical isolator 260 of similar function and interconnection as described with respect to FIG. 1. In this representative embodiment, local voltage source 230 is connected to a first wire of wiring pair w1, but may in the alternative be connected to a first wire of wiring pair w2 or a first wire of wiring pair wm.

Lighting module 500 shown in FIG. 3B includes a first string of LEDs 211, 212, 213, 214, 215, . . . , 21*n* connected in series. An anode of LED 211 is connected to a first wire of wiring pair w1 and a cathode of LED 21*n* is connected to a second wire of wiring pair w1 through resistor 271. The first string of LEDs 211, 212, 213, 214, 215, . . . , 21*n* is driven to emit light responsive to the first driving current. Amplifier 241 has an input connected to a first node between LED 21*n* of the first string and resistor 271, and is configured to amplify the LED current that has passed through the first string at the first node and provide a first amplified LED current as a first detected LED current to multiplexer 280. Lighting module 500 further includes a second string of LEDs 221, 222, 223, 224, 225, . . . , 22*n* connected in series. An anode of LED 221 is connected to a first wire of wiring pair w2 and a cathode of LED 22*n* is connected to a second wire of wiring pair w2 through resistor 272. The first string of LEDs 221, 222, 223, 224, 225, . . . , 22*n* is driven to emit light responsive to the second driving current. Amplifier 242 has an input connected to a second node between LED 22*n* of the second string and resistor 272, and is configured to amplify the LED current that has passed through the second string at the second node and provide a second amplified LED current as a second detected LED current to multiplexer 280. Lighting module 500 still further includes an mth string of LEDs 2*m*1, 2*m*2, 2*m*3, 2*m*4, 2*m*5, . . . , 2*mn* connected in series. An anode of LED 2*m*1 is connected to a first wire of wiring pair wm and a cathode of LED 2*mn* is connected to a second wire of wiring pair wm through resistor 27*m*. The mth string of LEDs 2*m*1, 2*m*2, 2*m*3, 2*m*4, 2*m*5, . . . , 2*mn* is driven to emit light responsive to the mth driving current. Amplifier 24*m* has an input connected to an mth node between LED 2*mn* of the mth string and resistor 27*m*, and is configured to amplify the LED current that has passed through the mth string at the mth node and provide an mth amplified LED current as an mth detected LED current to multiplexer 280.

Multiplexer 280 is configured to selectively output the first, second and mth detected LED currents to A/D converter 250 in sequence responsive to multiplex control signal mux_ctrl. In a representative embodiment, multiplexer 280 may be a switch that toggles between three input terminals respectively connected to the first, second and mth detected LED currents to selectively provide the detected LED currents to A/D converter 250 via an output terminal. A/D converter 250 converts the first, second and mth detected LED currents selectively provided from multiplexer 280 in sequence into respective digital signals that may be characterized as corresponding first, second and mth current feedback signals which are sequentially transmitted via wiring pair wfb to driver controller 360 within lighting driver 400. Driver controller 360 is configured to output the first, second and mth control signals responsive to the respective first, second and mth current feedback signals, and further responsive to the voltage sense signal and the dimmer sense signal, to independently control the LED currents (lighting currents) through each of the strings within lighting module 500 to be maintained at a same selected constant level, so that the light emitted from the strings may consequently be maintained at selected constant brightness. Multiplex control signal mux_ctrl may be a clocked signal or the like generated within LED module 500, and driver controller 360 may be configured as operable in synchronization with a similarly provided or generated clock to output the first, second and mth control signals responsive to the respective first, second and mth current feedback signals. In a representative embodiment, driver controller 360 may be configured to generate and send the mux_ctrl signal to lighting module 500 through an opto-coupler, or directly in the case where lighting driver 400 and lighting module 500 share a common ground reference. In accordance with this representative embodiment, strings having different numbers of LEDs and/or different color LEDs may also be independently controlled.

Figure 4:
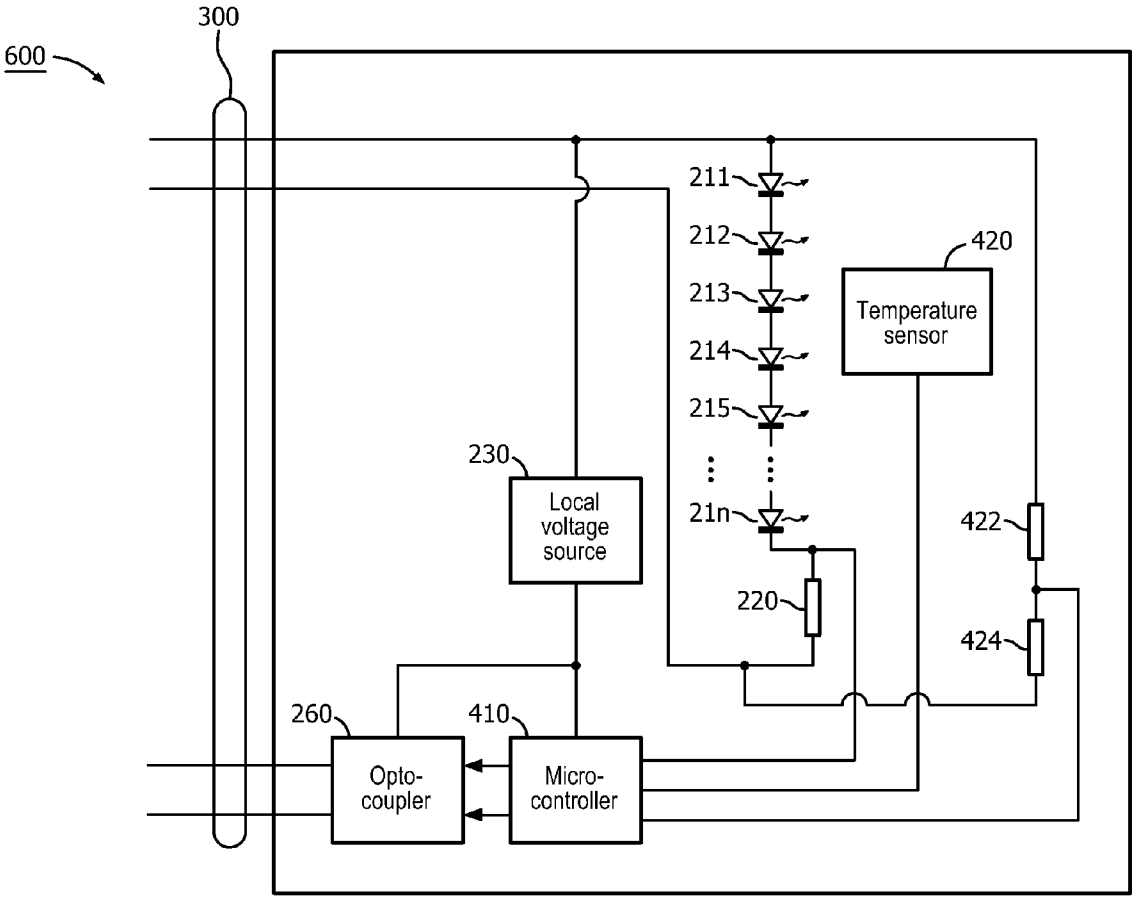
FIG. 4 illustrates an LED module usable with the lighting driver of FIG. 1, according to a representative embodiment.

FIG. 4 illustrates an LED module 600 usable with the lighting driver 100 of FIG. 1, according to a representative embodiment. Lighting module 600 includes similar components as LED module 200 shown in FIG. 1 which may be denoted with similar reference numerals. Detailed description of the similar components may hereinafter be omitted so as to not obscure the description of this representative embodiment.

LED module 600 as shown in FIG. 4 includes a string of LEDs 211, 212, 213, 214, 215, . . . , 21*n* connected in series. Cable 300 interconnects lighting driver 100 and LED module 600. Cable 300 includes a first wire connected between power converter 130 and a first end of the string at an anode of LED 211, and a second wire connected between power converter 130 and a second end of the string at a cathode of LED 21*n* via resistor 270. LEDs 211, 212, 213, 214, 215, . . . , 21*n* are driven to emit light responsive to the driving current provided from power converter 130 to the string via the first wire of cable 300. LED module 700 further includes local voltage source 230 and optical isolator (opto-coupler) 260 as shown and described with respect to FIG. 1.

As further shown in FIG. 4, an LED current (lighting current) that has passed or flowed through the string at the node between LED 21*n* and resistor 270 is provided to microcontroller 410. As further shown, resistor 422 includes a first end terminal connected to the first wire of cable 300. Resistor 424 includes a first end terminal connected to a second end terminal of resistor 422, and a second end terminal connected to the second wire of cable 300 that is connected to resistor 270, which is the microcontroller 410 side ground. A sensed voltage level indicative of a voltage across the LED string is provided from the node between resistors 422 and 424 to microcontroller 410. A temperature sensor 420 is configured to sense a temperature of the LEDs 211, 212, 213, 214, 215, . . . , 21*n* and provide a temperature sense signal indicative of the detected temperature to microcontroller 410. Microcontroller 410 is configured to output a digital signal including a current feedback signal responsive to the LED current at the node between LED 21*n* and resistor 270, an LED voltage feedback signal responsive to the voltage level at the node between resistors 422 and 424, and an LED temperature feedback signal responsive to the temperature sense signal provided by temperature sensor 420. Optical isolator (opto-coupler) 260 is connected to the output of microcontroller 410 and is configured to transmit the digital signal from microcontroller 410 via cable 300 to driver controller 160 within lighting driver 100 shown in FIG. 1. In this representative embodiment, driver controller 160 is configured to output the control signal to power controller 170 responsive to the current feedback signal, the LED voltage feedback signal and the LED temperature feedback signal, in addition to the voltage sense signal output from voltage measurement circuit 140 and the dimmer sense signal output from dimmer measurement circuit 150, to control the driving current output from power converter 130 to LED module 600.

Figure 5:
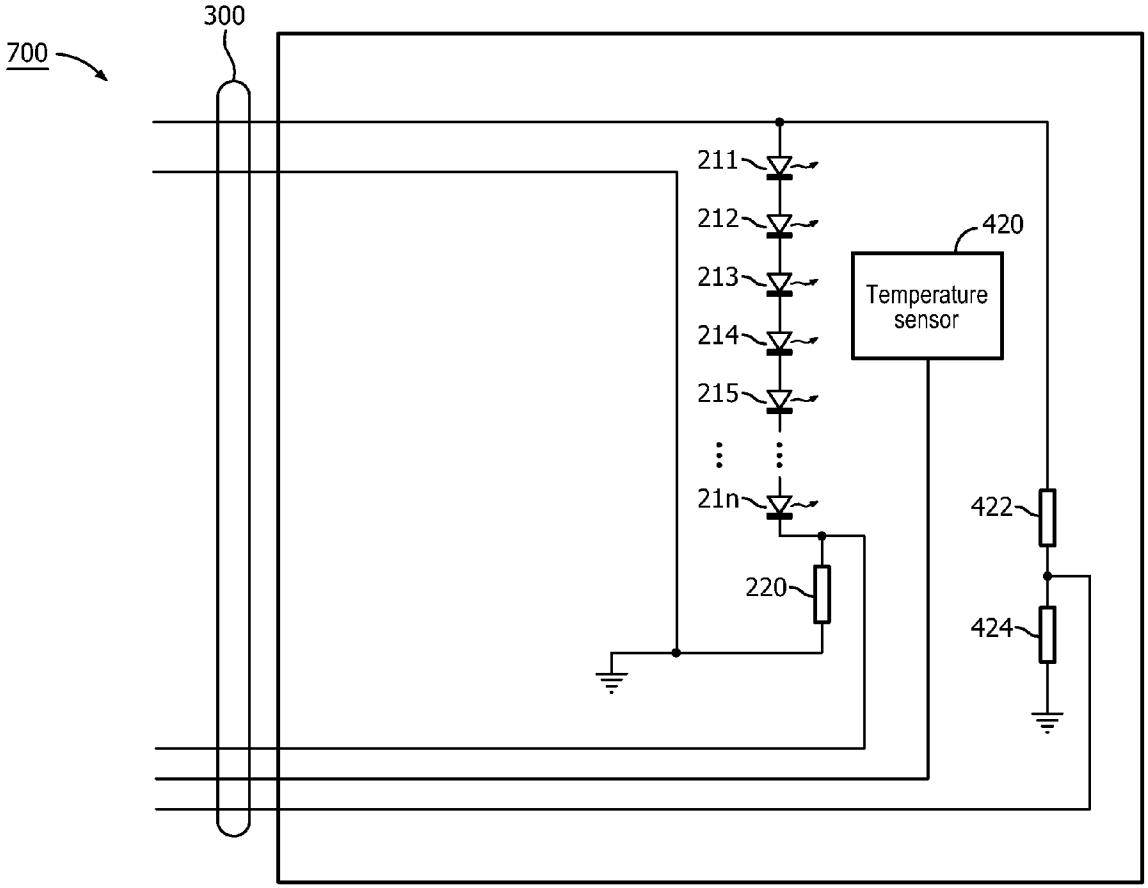
FIG. 5 illustrates an LED module usable with the lighting driver of FIG. 1, according to a representative embodiment.

FIG. 5 illustrates an LED module 700 usable with the lighting driver 100 of FIG. 1, according to a representative embodiment. Lighting module 700 includes similar components as lighting module 600 shown in FIG. 4 which may be denoted with similar reference numerals. Detailed description of the similar components may hereinafter be omitted so as to not obscure the description of this representative embodiment. In this representative embodiment, power converter 130 may include a flyback power converter for example, and the ground of the flyback power converter may be the same as the ground connected to driver controller 160. Accordingly, the current feedback signal responsive to the LED current at the node between LED 21*n* and resistor 270, the LED voltage feedback signal responsive to the voltage level at the node between resistors 422 and 424, and an LED temperature feedback signal provided by temperature sensor 420 may be directly transmitted to driver controller 160 of lighting driver 100 via cable 300.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited. Also, reference numerals appearing the claims, if any, are provided merely for convenience and should not be construed as limiting the claims in any way.

In the claims, as well as in the specification above, all transitional phrases such as "comprising," "including," "carrying," "having," "containing," "involving," "holding,"

"composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The invention claimed is:

1. A lighting system comprising:

a driver controller configured to output an independent control signal to each of a plurality of power controllers, the power controllers configured to control respective power converters:

the plurality of power converters connected to mains voltage and configured to provide a driving current responsive to each independent control signal, wherein each power converter is configured to output respective driving currents to a plurality of strings of LEDs:

a voltage measurement circuit configured to provide a voltage sense signal indicative of an amplitude of the mains voltage: and a light-emitting diode (LED) module comprising the plurality of strings of LEDs that emit light responsive to the driving currents, a plurality of amplifiers, each amplifier connected to one of the plurality of strings of LEDs and configured to amplify an LED current through each corresponding string:

a multiplexer connected to the outputs of the plurality of amplifiers, configured to receive the amplified LED currents as detected LED currents of each string and selectively output the detected LED currents, and an analog to digital converter connected to the multiplexer configured to convert the detected LED currents as selected by the multiplexer into digital signals and output the digital signals as current feedback signals;

wherein the driver controller is configured to output the control signals responsive to the voltage sense signal and each respective current feedback signal.

2. The lighting system of claim 1, wherein the LED module further comprises: an optical isolator connected between the analog to digital converter and the driver controller, and configured to enable transmission of the digital signals from the analog to digital converter to the driver controller as the current feedback signals: and a local voltage source connected to one of the power converters and configured to provide a local voltage to the amplifier, the analog to digital converter and the optical isolator.

3. The lighting system of claim 2, wherein the power converter comprises a buck power converter.

4. The lighting system of claim 2, wherein the analog to digital converter comprises a 12-bit analog to digital converter, and the optical isolator comprises a digital I2C opto-coupler.

5. The lighting system of claim 1 wherein the power converters and the driver controller have non-isolated ground references, and the digital signals from the analog to digital converter are output directly from the LED module as the current feedback signals to the driver controller.

6. The lighting system of claim 1, wherein the control signals comprise a pulse-width modulated (PWM) signal or an analog signal, and the lighting system is configured as responsive to the control signals to control the power converters to output the driving currents so as to maintain the LED currents at a selected constant level.

7. The lighting system of claim 6, wherein the power controllers comprise a power factor correction chip disposed within the power converters.

8. The lighting system of claim 1, further comprising: a dimmer connected to the mains voltage and configured to modify a phase of the mains voltage provided to the power converters to adjustably dim the light emitted by the LED module; and a dimmer measurement circuit connected to the dimmer, and configured to output a dimmer sense signal responsive to a detected modified phase of the mains voltage, wherein the driver controller is configured to output the control signals further responsive to the dimmer sense signal.

9. The lighting system of claim 1, wherein the LED module further comprises: a microcontroller configured to output the digital signals comprising the current feedback signals, an LED voltage feedback signal indicative of a voltage across the plurality of strings and LED temperature feedback signals indicative of a temperature of the LEDs within the plurality of strings, wherein the driver controller is configured to output the control signals further responsive to the LED voltage feedback signal and the LED temperature feedback signals.

10. The lighting system of claim 1, wherein the mains voltage comprises AC mains voltage within a range of about 90 volts AC to 480 volts AC.

11. The lighting system of claim 1, wherein the driver controller is configured to provide the control signals so as to maintain the LED currents at a selected constant level.

12. A lighting driver comprising:

a plurality of power converters connected to mains voltage and configured to provide driving currents to a solid state lighting load responsive to independent control signals:

a voltage measurement circuit configured to provide a voltage sense signal indicative of an amplitude of the mains voltage: and a driver controller configured to output the independent control signals responsive to the voltage sense signal and respective current feedback signals indicative of a lighting current through the solid state lighting load, wherein the power converters provide the driving currents to maintain the lighting currents at a selected constant level regardless of the amplitude of the mains voltage, wherein the current feedback signals are received from an analog to digital converter, wherein a multiplexer is connected to outputs of a plurality of amplifiers configured to amplify the currents through the solid state lighting load, and wherein the analog to digital converter connected to the multiplexer output configured to convert the current outputs from the multiplexer into digital signals and output the digital signals as the current feedback signals.

13. The lighting driver of claim 12, wherein the current feedback signal is indicative of lighting currents through a plurality of strings of a plurality of light emitting diodes (LEDs) within the solid state lighting load.

14. The lighting driver of claim 13, wherein the driver controller is configured to output the control signals further responsive to an LED voltage feedback signal indicative of a voltage across the plurality of strings and an LED temperature feedback signal indicative of a temperature of the LEDs within the plurality of strings.

15. The lighting driver of claim 12, further comprising:

a dimmer connected to the mains voltage and configured to modify a phase of the mains voltage provided to the power converters to adjustably dim the light emitted by the solid state lighting load; and a dimmer measurement circuit connected to the dimmer, and configured to output a dimmer sense signal responsive to a detected modified phase of the mains voltage, wherein the driver controller is configured to output the control signals further responsive to the dimmer sense signal.

16. The lighting driver of claim 12, wherein the control signals comprise a pulse-width modulated (PWM) signal or an analog signal, the lighting driver further comprising:

a power factor correction chip connected to the driver controller, and configured as responsive to the control signals to control the power converter to output the driving currents so as to maintain the lighting currents at the selected constant level.

17. A method of controlling a solid state lighting load comprising a plurality of strings of LEDs, the method comprising:

converting mains voltage to provide independent driving currents to the plurality of strings via a plurality of power converters, wherein the power converters are configured to provide independent driving currents to each respective string:

generating current feedback signals indicative of lighting currents through each string via a plurality of amplifiers, each amplifier configured to amplify the current through one of the strings, a multiplexer configured to receive the amplified currents and selectively output the selected amplified currents, and an analog to digital converter configured to receive the selected amplified currents and configured to convert the selected amplified currents into digital signals and output the digital signals as the current feedback signals; and detecting an amplitude of the mains voltage, wherein said converting comprises providing the independent driving currents to maintain light emitted from each of the strings at a selected constant brightness responsive to the detected amplitude of the mains voltage and the current feedback signals.

* * * * *